US010342364B2

(12) United States Patent
Buttignon

(10) Patent No.: US 10,342,364 B2
(45) Date of Patent: Jul. 9, 2019

(54) DISPLAY STAND

(71) Applicant: Stefano Buttignon, Staranzano (IT)

(72) Inventor: Stefano Buttignon, Staranzano (IT)

( * ) Notice: Subject to any disclaimer, the term of this patent is extended or adjusted under 35 U.S.C. 154(b) by 0 days.

(21) Appl. No.: 16/029,579

(22) Filed: Jul. 7, 2018

(65) Prior Publication Data

US 2019/0038048 A1 Feb. 7, 2019

Related U.S. Application Data

(60) Provisional application No. 62/540,589, filed on Aug. 3, 2017.

(51) Int. Cl.

| | |
|---|---|
| ***A47F 5/00*** | (2006.01) |
| ***A47B 47/00*** | (2006.01) |
| ***A47F 5/10*** | (2006.01) |
| ***A47F 3/14*** | (2006.01) |
| ***A47G 29/08*** | (2006.01) |

(52) U.S. Cl.

CPC ..... *A47F 5/0025* (2013.01); *A47B 47/0075* (2013.01); *A47F 3/14* (2013.01); *A47F 5/10* (2013.01); *A47G 29/08* (2013.01); *A47B 2230/0092* (2013.01)

(58) Field of Classification Search

CPC . A47B 47/0075; A47B 47/042; A47F 5/0025; A47G 29/08

See application file for complete search history.

(56) References Cited

U.S. PATENT DOCUMENTS

| | | | | | |
|---|---|---|---|---|---|
| 1,832,801 | A * | 11/1931 | Wright | A47B 47/042 | 108/101 |
| 2,279,864 | A * | 4/1942 | Eide | A47B 47/042 | 206/557 |
| 2,334,912 | A * | 11/1943 | Eide | A47B 47/042 | 108/158.12 |
| 2,560,957 | A * | 7/1951 | Johnson | A47B 47/042 | 108/180 |
| 4,082,356 | A * | 4/1978 | Johnson | A47C 4/021 | 273/160 |
| 4,140,065 | A * | 2/1979 | Chacon | A47C 4/021 | 108/156 |
| 4,153,311 | A * | 5/1979 | Takahashi | A47B 47/042 | 312/107 |

(Continued)

FOREIGN PATENT DOCUMENTS

| | | | | |
|---|---|---|---|---|
| DE | 202011004188 U1 * | 6/2011 | A47B 3/06 | |
| DE | 202013103820 U1 * | 11/2014 | F16B 5/0614 | |

(Continued)

*Primary Examiner* — Stanton L Krycinski

(74) *Attorney, Agent, or Firm* — Steven H. Greenfield; Greenfield Invention and Patent Consulting Inc.

(57) ABSTRACT

A display stand configured for displaying personal items or merchandise items and a method of assembling the display stand are disclosed. The display stand comprises of an upright panel and a base panel that are combined in a way that the resulting structure is sturdy yet easy to assemble and disassemble. The assembly of the display panel is accomplished by inserting a closed elongated slot of the upright panel into an open slot of the base panel and turning the base panel such that a solid strip of the base panel is disposed inside the closed elongated slot of the upright panel. A tab is then inserted into the open slot of the base panel to seal the opening.

7 Claims, 8 Drawing Sheets

(56) References Cited

U.S. PATENT DOCUMENTS

| | | | | | |
|---|---|---|---|---|---|
| 4,582,002 | A * | 4/1986 | Wright | A47B 47/042 | 108/60 |
| 5,363,775 | A * | 11/1994 | Simpson | A47B 47/042 | 108/157.13 |
| 6,619,749 | B2 * | 9/2003 | Willy | A47B 3/06 | 108/158.12 |
| 8,079,315 | B2 * | 12/2011 | Berent | A47B 3/06 | 108/157.14 |
| 9,320,378 | B2 | 4/2016 | Phipps | | |
| 9,332,838 | B1 * | 5/2016 | Kilday | A47B 47/0091 | |
| 9,909,604 | B1 * | 3/2018 | Fawcett | F16B 12/125 | |
| 10,041,521 | B2 * | 8/2018 | Shin | A47B 47/0075 | |
| 2009/0120889 | A1 * | 5/2009 | Cebollero | A47B 17/00 | 211/134 |

FOREIGN PATENT DOCUMENTS

| | | | | | |
|---|---|---|---|---|---|
| DE | 202015003398 | U1 * | 5/2015 | A47B 85/04 | |
| DE | 102016200471 | A1 * | 7/2017 | A47F 5/10 | |
| FR | 2974604 | A1 * | 11/2012 | A47B 47/042 | |
| WO | WO-9840633 | A1 * | 9/1998 | A47B 47/042 | |

* cited by examiner

DISPLAY STAND

RELATED APPLICATIONS

This application claims priority from provisional application 62/540,589 filed on Aug. 3, 2017.

FIELD OF THE INVENTION

The present invention relates to a stand assembly that may be used for organizing personal items and devices in a way that the items are easily accessible to the user. The stand may also be used for displaying items for sale in a way that the items are easy to view from various angles.

BACKGROUND OF THE INVENTION

It is desirable that a stand configured for displaying multiple personal or merchandise items for display be sturdy and easy to assemble and disassemble. The stands currently marketed are deficient with regard to at least one of these characteristics. The display stand of the present invention addresses both of these issues.

SUMMARY OF THE PRESENT INVENTION

In one aspect of the present invention, a display stand comprises a base panel containing an elongated slot, the elongated slot having a first side end and a second end, the first side end of the elongated slot being open at a first side end of the base panel, the second side end of the elongated slot being closed inside the base panel, the base panel also comprising an indentation at a second side end of the base panel, the second side end of the base panel being disposed at an opposing end of the first side end of the base panel, the indentation being bridged with the second end of the elongated slot by a solid strip; and an upright panel comprising a closed elongated slot, the closed elongated slot having a first side sealed by a closure strip, the closed elongated slot also comprising a second end disposed at an opposing side of the closure strip, the base panel and the upright panel being combined in a way that the solid strip of the base panel is disposed inside the closed elongated slot of the upright panel. In another aspect of the present invention, a method for assembling a display stand comprises: providing a base panel containing an elongated slot, the elongated slot having a first side end and a second end, the first side end of the elongated slot being open at a first side end of the base panel, the second side end of the elongated slot being closed inside the base panel, the base panel also comprising an indentation at a second side end of the base panel, the second side end of the base panel being disposed at an opposing end of the first side end of the base panel, the indentation being bridged with the second end of the elongated slot by a solid strip; providing an upright panel comprising a closed elongated slot, the closed elongated slot having a first side sealed by a closure strip, the closed elongated slot also comprising a second end disposed at an opposing side of the closure strip; with the upright panel being disposed in an upright position and the base panel disposed in a horizontal position, inserting the closure strip of the upright panel into the elongated slot of the base panel; turning the base panel clockwise about 180 degrees such that the solid strip of the base panel is disposed inside the closed elongated slot; and laying a bottom side of the base panel on a surface.

These and other features, aspects and advantages of the present invention will become better understood with reference to the following drawings, description and claims.

DETAILED DESCRIPTION OF THE INVENTION

Figure 1:
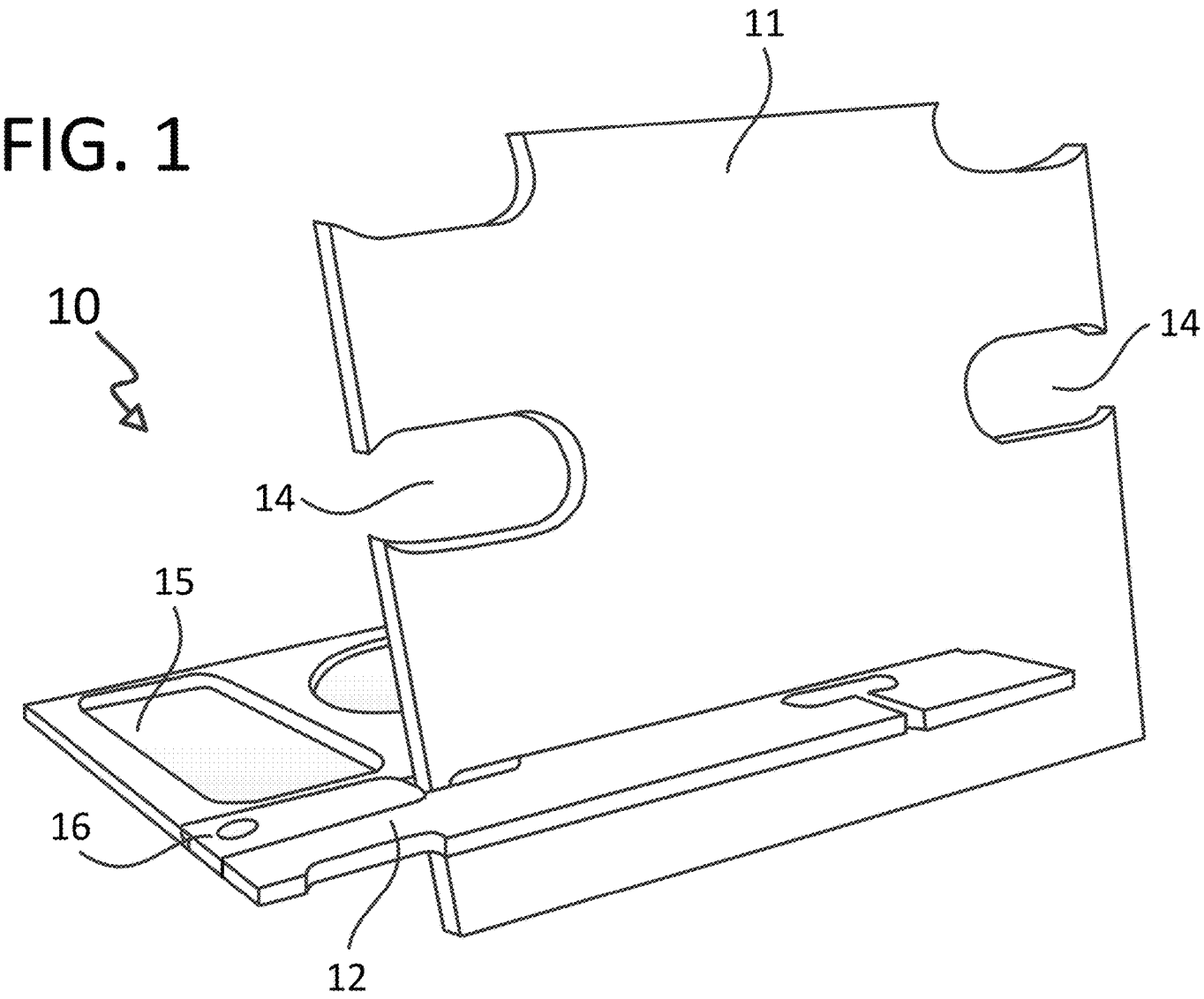
FIG. 1 is a rear perspective view of the stand assembly according to an embodiment of the present invention.

The following detailed description is of the best currently contemplated modes of carrying out exemplary embodiments of the invention. The description is not to be taken in a limiting sense, but is made merely for the purpose of illustrating the general principles of the invention.

The stand assembly of the present invention is portrayed in FIGS. 1-8. The assembly contains two panels that are combined to form the stand structure: a base panel 12 disposed on a surface and an upright panel 11 that is substantially perpendicular to the base panel 12. The base panel 12 and the upright panel 11 are combined in a way that the combined structure is easy to assemble and disassemble, yet the base panel 12 and upright panel 11 are immovably secured in relation to one another. The upright panel 11 contains a plurality of cutouts 14 in which various objects may be placed for stowage or display. These may include personal items such as pens, watches and cell phones or merchandise items for customers to view in a store. The base panel may also contain cutouts 17 for similar purposes.

The base panel 12 comprises an elongated slot 19 that is open at the length end of the base panel 12 and takes up a portion of the full length of base panel 12. At the opposite end of elongated slot 19, base panel 12 comprises an indentation 25 that is bridged with the elongated slot 19 by solid strip 22 shown between broken lines in FIGS. 4, 5 and 7. The upright panel 11 comprises an elongated closed slot 18 that takes up a portion of the length of the upright panel 11 and ends at one end with a short closure strip 27.

Figure 5:
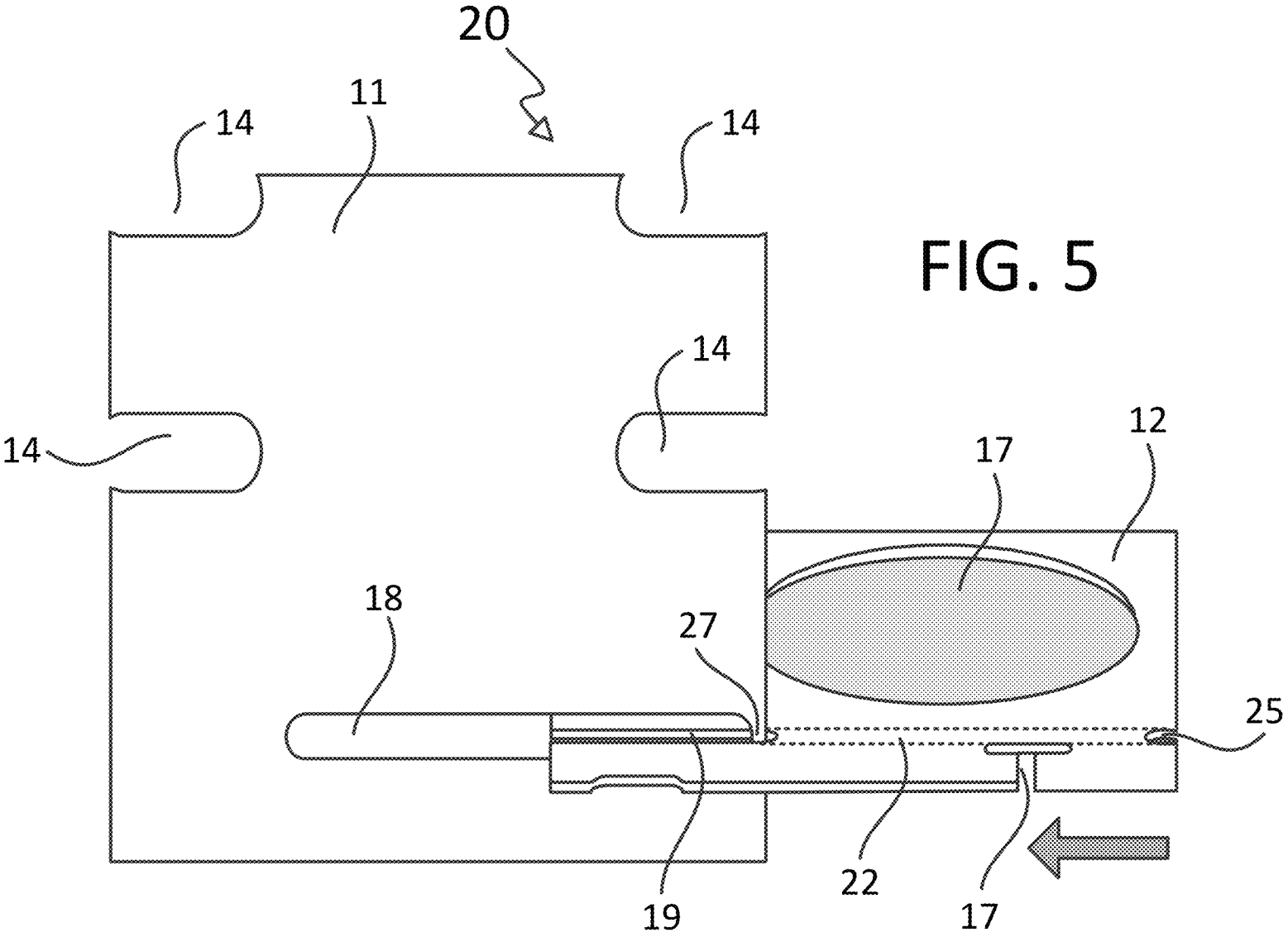
FIGS. 5-8 illustrate the steps of combining the panels to construct the stand assembly.

To assemble the stand, upright panel 11 is positioned vertically on a surface while the base panel 12 is positioned horizontally with the surface such that closure strip 27 and a portion of the upright panel 11 elongated closed slot 18 is inserted into the open slot 19 of the base panel 12 as shown in FIG. 5.

Figure 2:
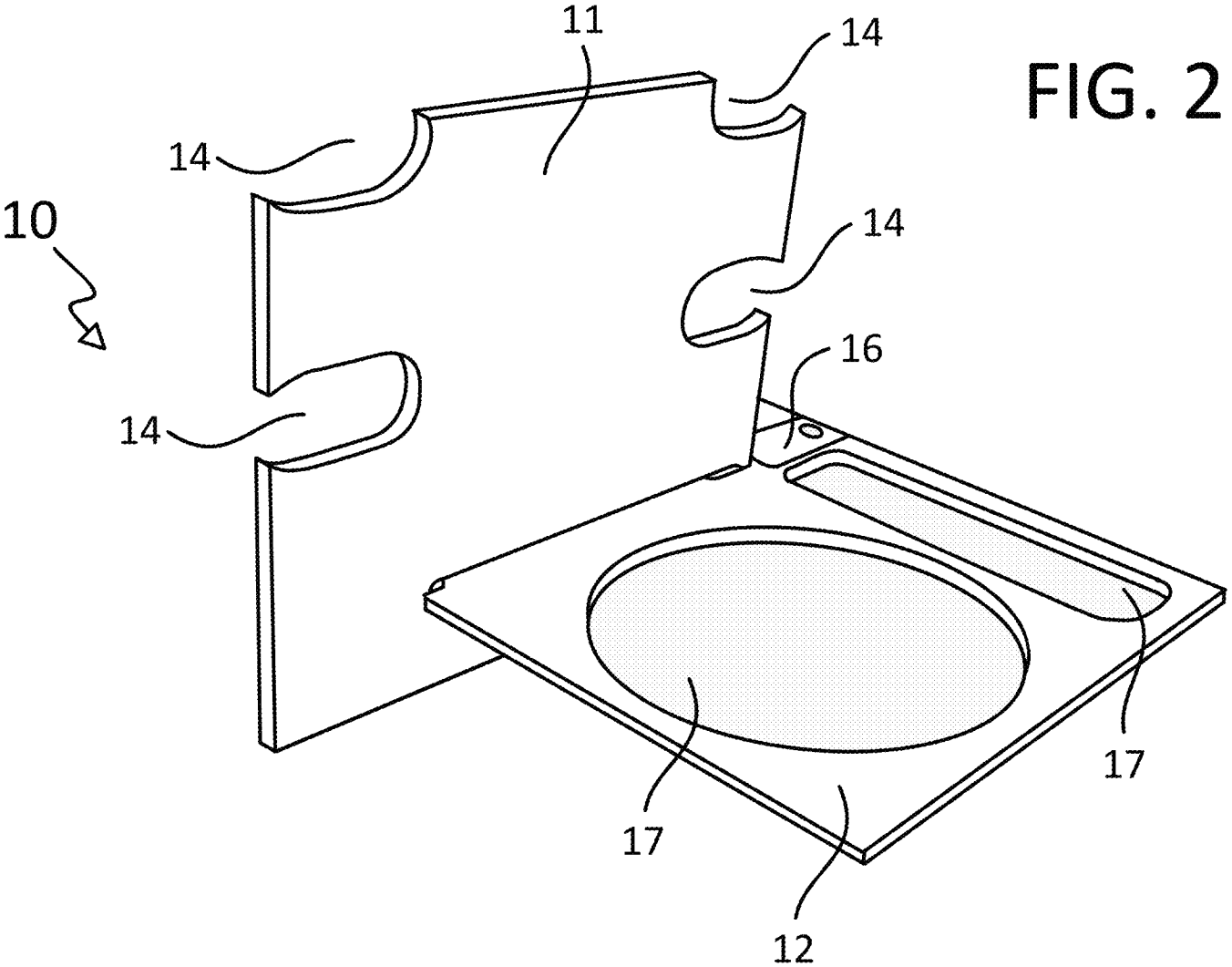
FIG. 2 portrays a front and side perspective view of the present invention stand assembly.
Figure 3:
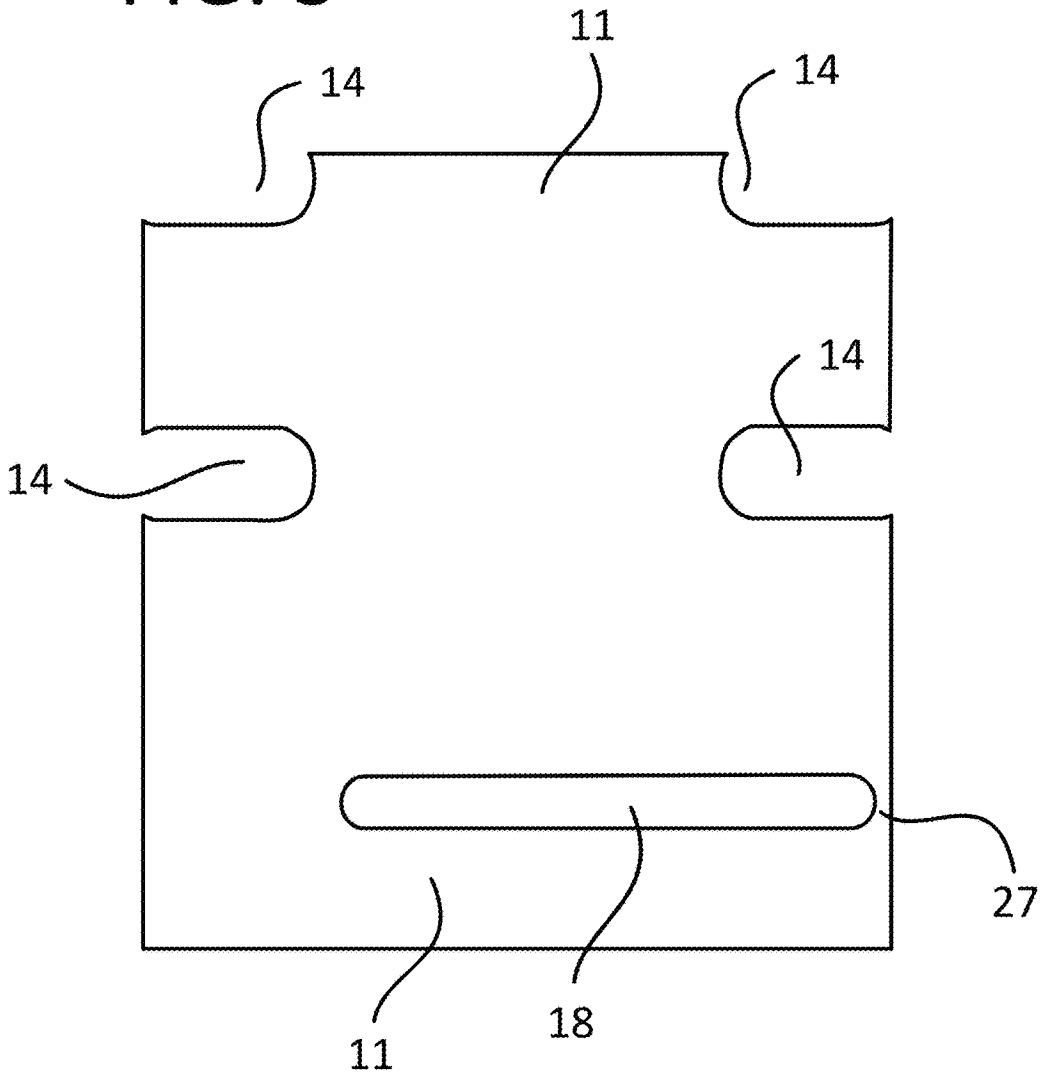
FIG. 3 shows the upright panel that is assembled to form the stand assembly structure.
Figure 4:
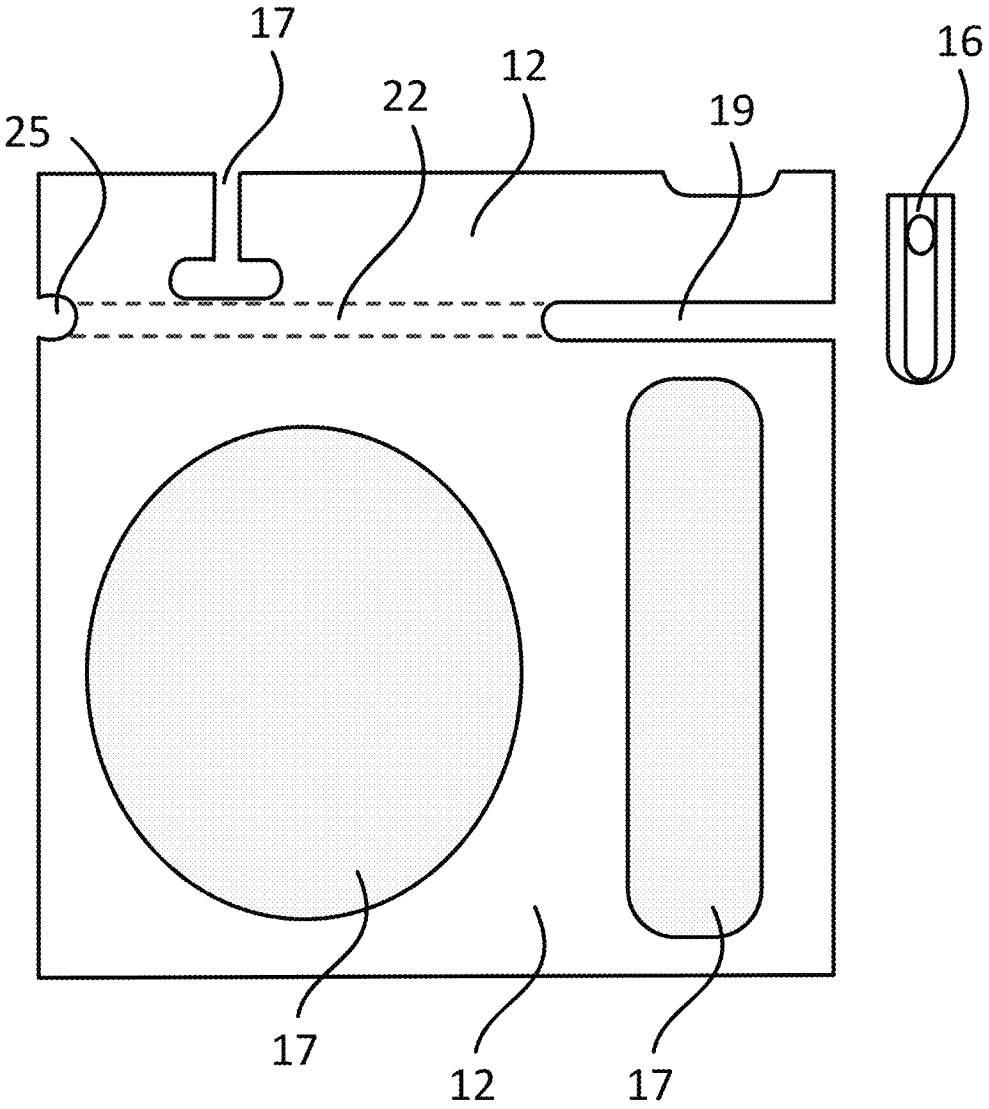
FIG. 4 shows the base panel that is assembled to form the stand assembly structure.
Figure 6:
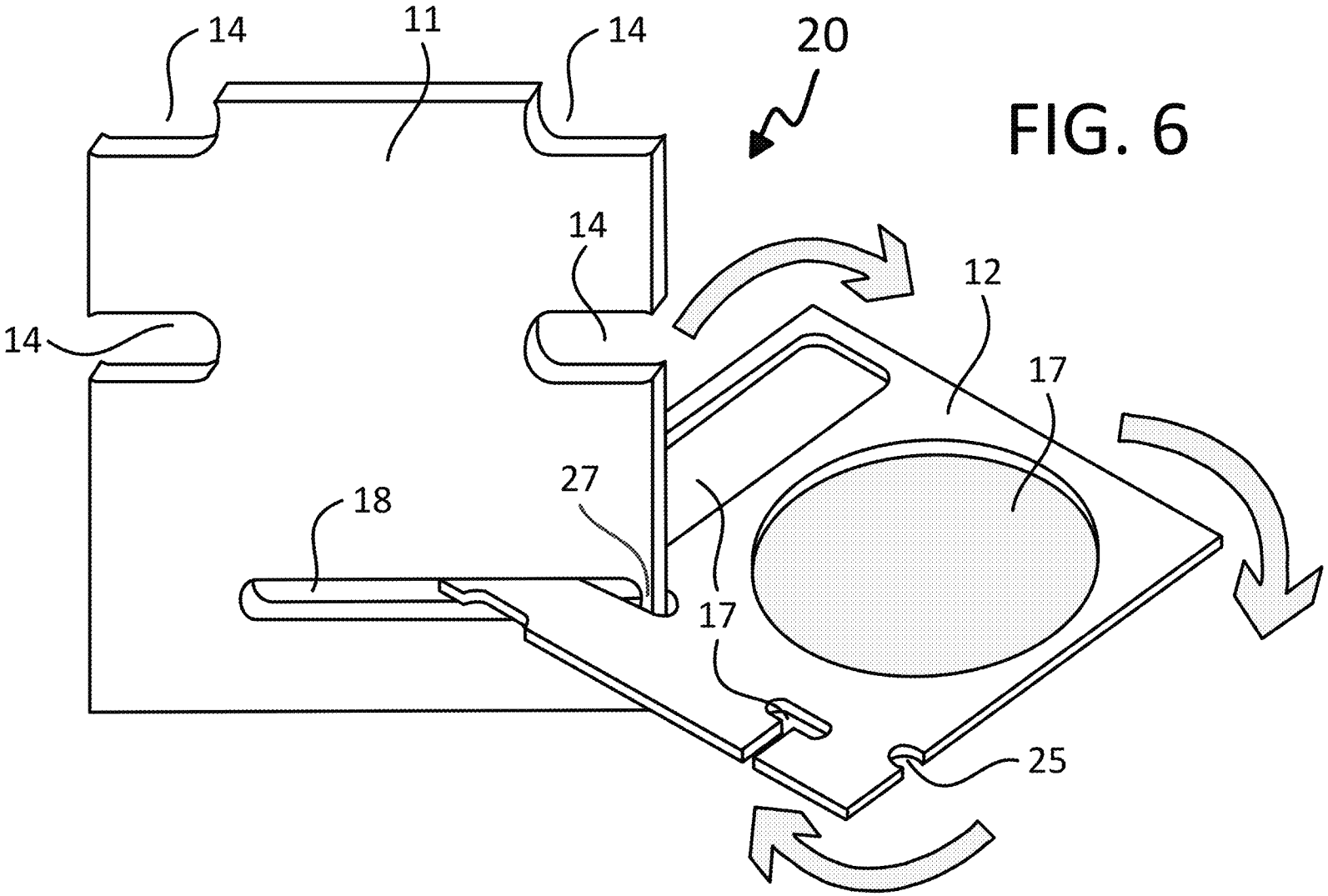
Figure 7:
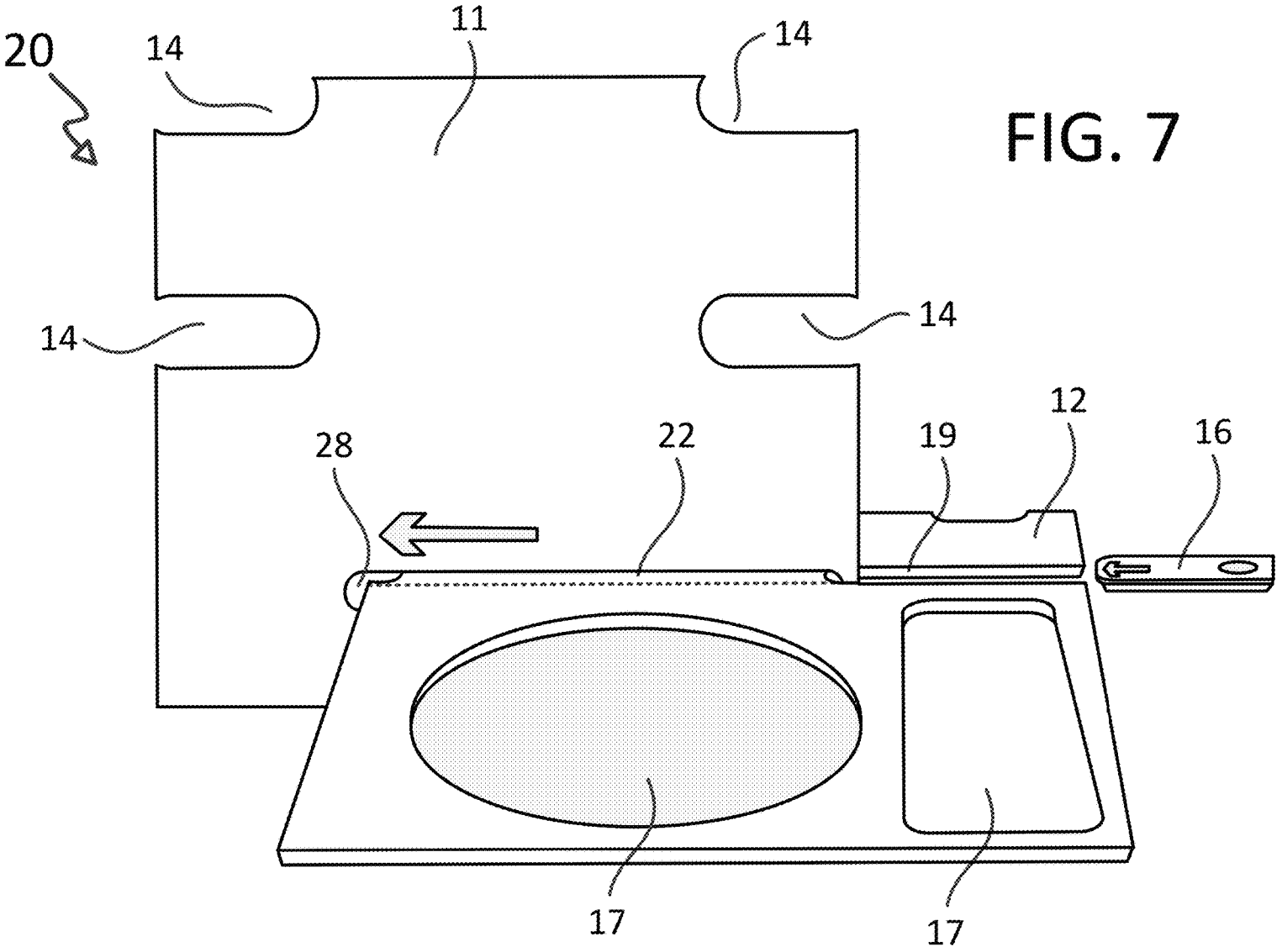

In the next step, the upright panel 11 is turned clockwise 180 degrees in a way that the solid strip 22 is placed inside elongated closed slot 18 as shown in FIGS. 6 and 7. The bottom end of the base panel 12 is placed on a surface such that the base panel 12 is positioned at an upward slant from a horizontal position and the upright panel 11 angles down slightly from a vertical stance as depicted in FIGS. 1 and 2. In this configuration, the base panel 12 supports upright panel 11 and prevents the stand assembly from breaking up.

Figure 8:
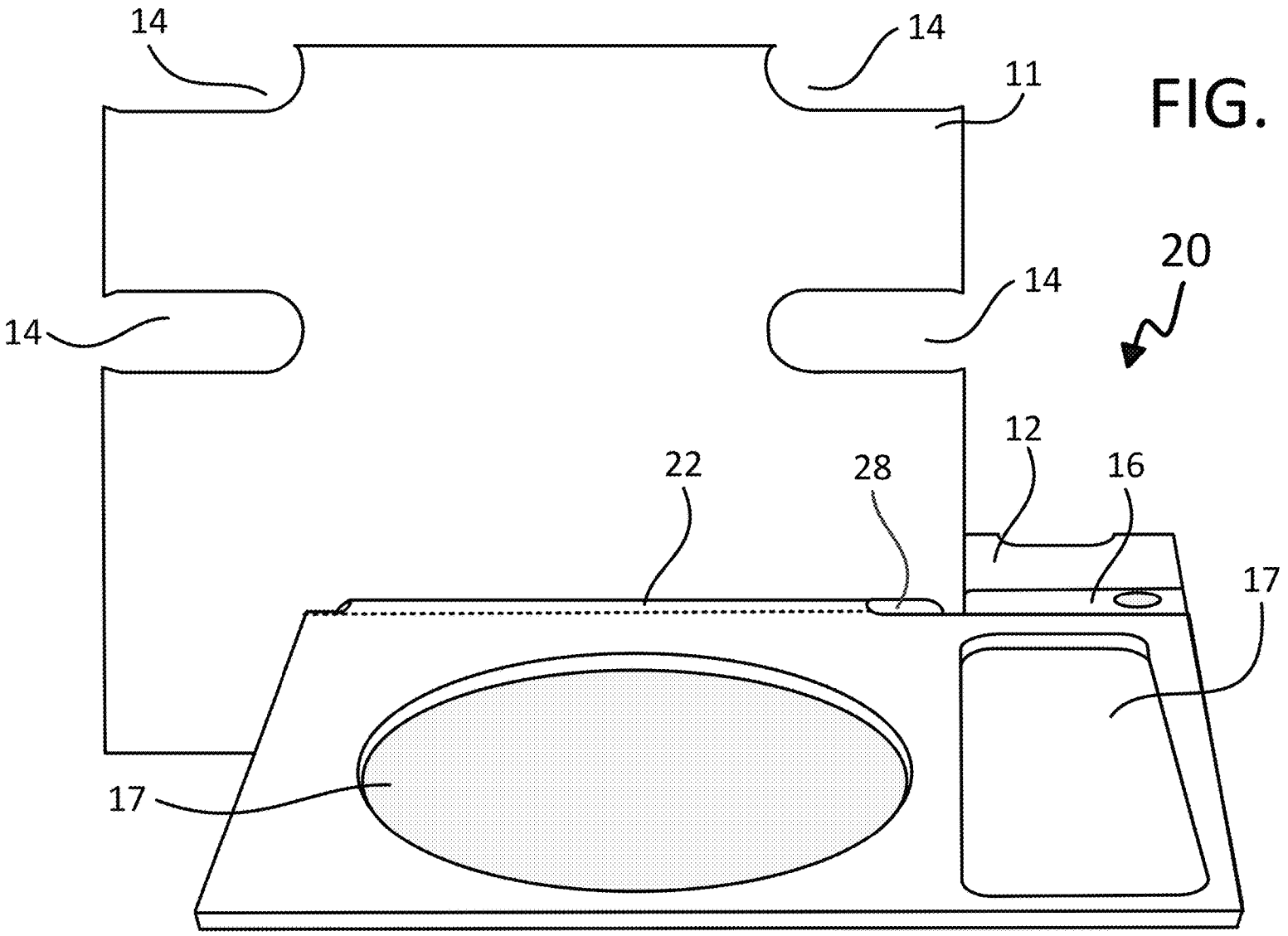

The solid strip 22 is shorter than closed slot 18. This allows the upright panel 11 to shift sideways from a position of having one end of the elongated closed slot 18 being wedged inside indentation 25 as shown in FIGS. 1, 2 and 8 to a position where the other end of elongated closed slot 18 is placed against closure strip 27 as shown in FIG. 7. In either case, a gap 28 is formed between solid strip 22 and the ends of the elongated closed slot 18. The gap 28 provides the needed flexibility to maneuver the solid strip 22 into the closed slot 18 in order to assemble the display stand 10 and to disassemble it. The optimal support for the upright panel 11 is achieved in the position in which the end of the elongated closed slot 18 is wedged inside the indentation 25. A tab 16 configured for tight fitting into the open slot 19 seals the open slot 19 so as to prevent unintended sideways slippage of the upright panel 11. Disassembling the stand is done by reversing the order of the assembly steps.

It should be understood, of course, that the foregoing relates to exemplary embodiments of the invention and that modifications may be made without departing from the spirit and scope of the invention.

I claim:

1. A display stand comprising:

a base panel containing an elongated slot, the elongated slot having a first side end and a second end, said first side end of the elongated slot being open at a first side end of the base panel, said second end of the elongated slot being closed inside the base panel, the base panel also comprising an indentation at a second side end of the base panel, said second side end of the base panel being disposed at an opposing end of the first side end of the base panel, said indentation being bridged with the second end of the elongated slot by a solid strip; and an upright panel comprising a closed elongated slot, said closed elongated slot having a first side sealed by a closure strip, said closed elongated slot also comprising a second end disposed at an opposing side of the closure strip, the base panel and the upright panel being combined in a way that the solid strip of the base panel is disposed inside the closed elongated slot of the upright panel, wherein the second end of the closed elongated slot of the upright panel is wedged inside the indentation at the second side end of the base panel, wherein a bottom side of the base panel is disposed on a surface in a way that a top side of the base panel is disposed at an upward slant and the upright panel is disposed at a downward slant toward the bottom side of the base panel, wherein the upright panel is configured to be wedged inside the base panel by a) placing the upright panel in an upright position and the base panel disposed in a horizontal position, b) inserting the closure strip of the upright panel into the first side open end of the base panel elongated slot and c) turning the base panel clockwise about 180 degrees such that the solid strip of the base panel is disposed inside the closed elongated slot.

2. The display stand of claim 1, wherein the base panel further comprises a plurality of cutouts for placing objects for display.

3. The display stand of claim 1, wherein the upright panel further comprises a plurality of cutouts for placing objects for display.

4. The display stand of claim 1, further comprising a tab configured for sealing the open end of the base panel elongated slot.

5. A method for assembling a display stand, the method comprising:

providing a base panel containing an elongated slot, the elongated slot having a first side end and a second end, said first side end of the elongated slot being open at a first side end of the base panel, said second side end of the elongated slot being closed inside the base panel, the base panel also comprising an indentation at a second side end of the base panel, said second side end of the base panel being disposed at an opposing end of the first side end of the base panel, said indentation being bridged with the second end of the elongated slot by a solid strip;

providing an upright panel comprising a closed elongated slot, said closed elongated slot having a first side sealed by a closure strip, said closed elongated slot also comprising a second end disposed at an opposing side of the closure strip;

with the upright panel being disposed in an upright position and the base panel disposed in a horizontal position, inserting the closure strip of the upright panel into the first side open end of the base panel elongated slot;

turning the base panel clockwise about 180 degrees such that the solid strip of the base panel is disposed inside the closed elongated slot; and laying a bottom side of the base panel on a surface.

6. The method for assembling the display stand of claim 5, further comprising sliding said base panel toward the second end of the closed elongated slot of the upright panel, said sliding wedging the second end of the upright panel closed elongated slot into the indentation at the second side end of the base panel.

7. The method for assembling the display stand of claim 5, further comprising inserting a sealing tab into the open end of the base panel elongated slot.

* * * * *